US009829186B2

(12) United States Patent
Becht et al.

(10) Patent No.: US 9,829,186 B2
(45) Date of Patent: Nov. 28, 2017

(54) SEMICONDUCTOR LAMP WITH REARWARD BASE REGION

(71) Applicant: OSRAM GmbH, Munich (DE)

(72) Inventors: Roland Becht, Dorlisheim (FR); Eric Korndoerfer, Herbrechtingen (DE)

(73) Assignee: Ledvance GmbH (DE)

( * ) Notice: Subject to any disclaimer, the term of this patent is extended or adjusted under 35 U.S.C. 154(b) by 623 days.

(21) Appl. No.: 14/376,438

(22) PCT Filed: Jan. 8, 2013

(86) PCT No.: PCT/EP2013/050238

§ 371 (c)(1),
(2) Date: Aug. 4, 2014

(87) PCT Pub. No.: WO2013/117359

PCT Pub. Date: Aug. 15, 2013

(65) Prior Publication Data

US 2014/0376236 A1 Dec. 25, 2014

(30) Foreign Application Priority Data

Feb. 7, 2012 (DE) ..... 10 2012 201 794

(51) Int. Cl.
*F21V 23/06* (2006.01)
*H01R 33/90* (2006.01)
(Continued)

(52) U.S. Cl.
CPC ..... *F21V 23/06* (2013.01); *F21K 9/23* (2016.08); *H01R 33/90* (2013.01); *F21Y 2115/10* (2016.08)

(58) Field of Classification Search
CPC . F21V 23/06; F21K 9/23; H01R 33/90; F21Y 2115/10
See application file for complete search history.

(56) References Cited

U.S. PATENT DOCUMENTS

2005/0135098 A1 6/2005 Currie et al.
2010/0117552 A1 5/2010 Lee
2010/0176730 A1* 7/2010 Lee ..... F21S 8/026 315/113

FOREIGN PATENT DOCUMENTS

CN 101682160 A 3/2010
CN 201539757 U 8/2010
(Continued)

OTHER PUBLICATIONS

Chinese Office Action based on application No. 201380008037.2 (7 pages and 7 pages of English translation) dated Aug. 12, 2016 (Reference Purpose Only).
(Continued)

*Primary Examiner* — David V Bruce
(74) *Attorney, Agent, or Firm* — Hayes Soloway PC

(57) ABSTRACT

Various embodiments relate to a semiconductor bulb, including a housing, and at least one semiconductor light source that is arranged on the housing. The housing includes a rearward base region that is embodied from an electrically non-conductive material for the purpose of engaging in a bulb socket. At least one electrical contact element is arranged on the base region for the purpose of contacting the bulb socket. The base region is embodied for the purpose of arranging electrical contact elements of different base types.

14 Claims, 3 Drawing Sheets

(51) Int. Cl.
*F21K 9/23* (2016.01)
*F21Y 115/10* (2016.01)

(56) References Cited

FOREIGN PATENT DOCUMENTS

| | | | |
|---|---|---|---|
| CN | 201884988 | U | 6/2011 |
| FR | 2941334 | A3 | 7/2010 |
| JP | 2009043447 | A | 2/2009 |
| WO | 2008142624 | A1 | 11/2008 |

OTHER PUBLICATIONS

ISR, from the corresponding PCT/EP2013/050238, dated Apr. 26, 2013.
English Abstract of JP2009043447, Sharp KK, Feb. 26, 2009.
English Abstract of FR2941334, Mainhouse Xiamen Electronics, Jul. 23, 2010.

* cited by examiner

SEMICONDUCTOR LAMP WITH REARWARD BASE REGION

RELATED APPLICATIONS

The present application is a national stage entry according to 35 U.S.C. §371 of PCT application No.: PCT/EP2013/050238 filed on Jan. 8, 2013, which claims priority from German application No.: 10 2012 201 794.1 filed on Feb. 7, 2012, and is incorporated herein by reference in its entirety.

TECHNICAL FIELD

Various embodiments relate to a semiconductor lamp including a housing and at least one semiconductor light source that is arranged on the housing, wherein the housing includes a rearward base region that is embodied from an electrically non-conductive material for the purpose of engaging in a bulb socket and wherein at least one electrical contact element is arranged on the base region for the purpose of contacting the bulb socket. Various embodiments further relate to a method for producing a semiconductor lamp having an Edison base or a bayonet base, wherein the method includes at least the steps of plugging on the contact cap and connecting at least one current supplying element. The present disclosure can be applied in a particularly advantageous manner for retrofit bulbs having a bi-pin base, Edison base and/or bayonet base.

BACKGROUND

LED bulbs of the type involved are frequently used as retrofit bulbs in order to replace conventional bulbs (different types of light bulbs, halogen bulbs etc.) and it is necessary to be able to use said LED bulbs in corresponding conventional bulb sockets. For this purpose, retrofit bulbs are produced to fit in each case the type of bulb that is to be replaced.

SUMMARY

Various embodiments provide a simplified production process for semiconductor lamps.

Various embodiments provide a semiconductor lamp including a housing and at least one semiconductor light source that is arranged on the housing, wherein the housing includes a rearward base region that is embodied from an electrically non-conductive material for the purpose of engaging in a bulb socket, wherein at least one electrical contact element is arranged on the base region for the purpose of contacting the bulb socket and wherein the base region is embodied for the purpose of arranging electrical contact elements of different base types.

This semiconductor lamp provides the advantage that it is possible to produce different base types with the same base region. As a consequence, it is possible to reduce the number of components for different base types. Thus, inter alia, a simplified machine concept is also rendered possible. Furthermore, a so-called "production-on-demand" having a reduction of diversity in part pieces becomes possible in a simpler manner. There is also a reduction in costs concerning the storage of basic materials. Furthermore, shorter conversion times between different base types can be achieved in the production process. A process of fitting the base can also be simplified.

In one embodiment, the base region is designed for the purpose of arranging electrical contact elements at least of two socket types of the relevant group, said group including at least one Edison base, a bipin base and a bayonet base. As a consequence, semiconductor lamps can be provided with a greater range of bases in a simple manner.

A further embodiment is designed so that the base region includes a first end-side base section that is designed for the purpose of receiving the front ends of bipin contact pins and for installation in a bipin bulb socket, and also a second base section that connects to the front of the end-side base section and said second base section includes a larger diameter than the first base section and is designed for the purpose of endwise plugging on the electrical contact element in the form of a contact cap of an Edison base or a bayonet base. This embodiment provides the advantage that the bipin contact pins can be assembled without any changes or with only very small changes in relation to the existing base and furthermore caps of Edison bases or bayonet bases can also be fastened to the identical base region at least by virtue of a frictionally-engaged connection in a simple manner.

It is preferred that the first base section includes a height of approx. 12 mm and/or at least at a maximum height a diameter of approx. 22.6 mm. Thus, it is possible for the first base section to be designed in a standard manner for the purpose of installing said first base section in a bulb socket that accepts bipin bases.

It is further preferred that the second base section includes a diameter of approx. 25 mm (in particular including 24.8 mm) and/or a height of approx. 7.5 mm. Thus, a sufficiently tight fit is provided for caps having a diameter of 26 mm and 27 mm, for example of the type B22d, E26 and E27.

In a further embodiment, the second base section includes on the side at least one depression in which the (typically at least predominantly metallic) contact cap can be pressed in locally in a plastic manner. As a consequence, the cap can be connected to the second base section in a simple and cost-effective manner in a form-fitting manner and consequently in a manner that is extremely secure against being pulled apart.

The base region can be embodied in particular in such a manner that said base region can be embodied optionally as an Edison base of the type E27, as a bipin base of the type GU10 or GZ10 or as a bayonet base of the type B22*d*.

A further embodiment of the disclosure is designed in such a manner that the base region is a lower housing region of a driver housing that is provided for the purpose of receiving a driver. The semiconductor lamp can thus be assembled in a particularly simple manner and it is particularly simple to interconnect electrically between the driver and the at least one electrical contact element.

In a further embodiment, an upper housing region of the driver housing includes a contact surface for the at least one semiconductor light source.

In a further development, the semiconductor lamp is a retrofit bulb, in particular for bulbs having a bipin base, Edison base and bayonet base.

In a further development, the semiconductor lamp is a light bulb-retrofit bulb for the purpose of replacing a conventional light bulb or is a halogen bulb-retrofit bulb for the purpose of replacing a conventional halogen bulb.

The object is also achieved by virtue of a method for producing a semiconductor lamp having an Edison base or a bayonet base, wherein the method includes at least the following steps: plugging on the contact cap; connecting at least one current supplying element; and locally pressing in the contact cap in at least one depression on the side of the second base section. The method also renders it possible to connect the cap to the second base section in a simple and cost-effective manner in a form-fitting manner and consequently in a manner that is extremely secure against being pulled apart.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
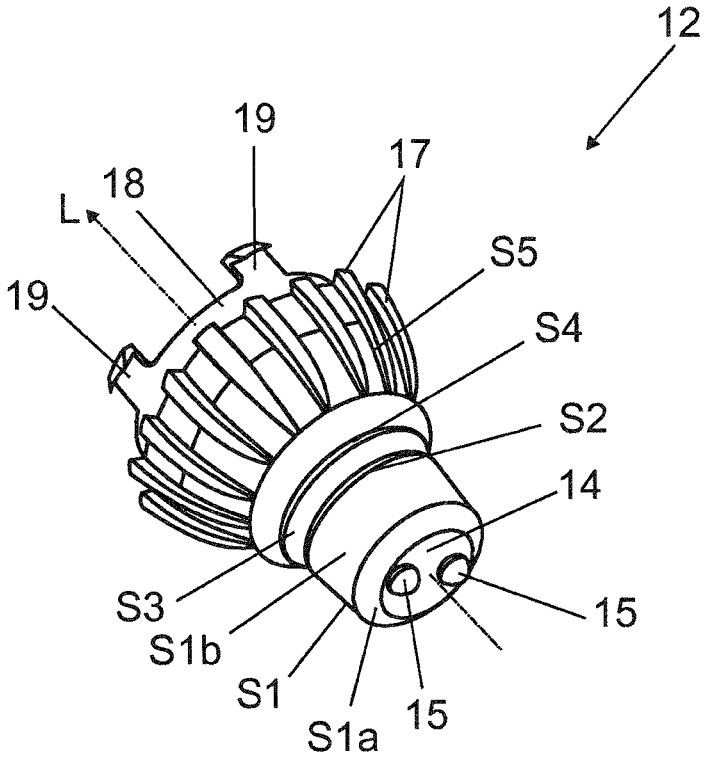
FIG. 1 illustrates a base region of a semiconductor lamp in a view that is inclined from below.
Figure 2:
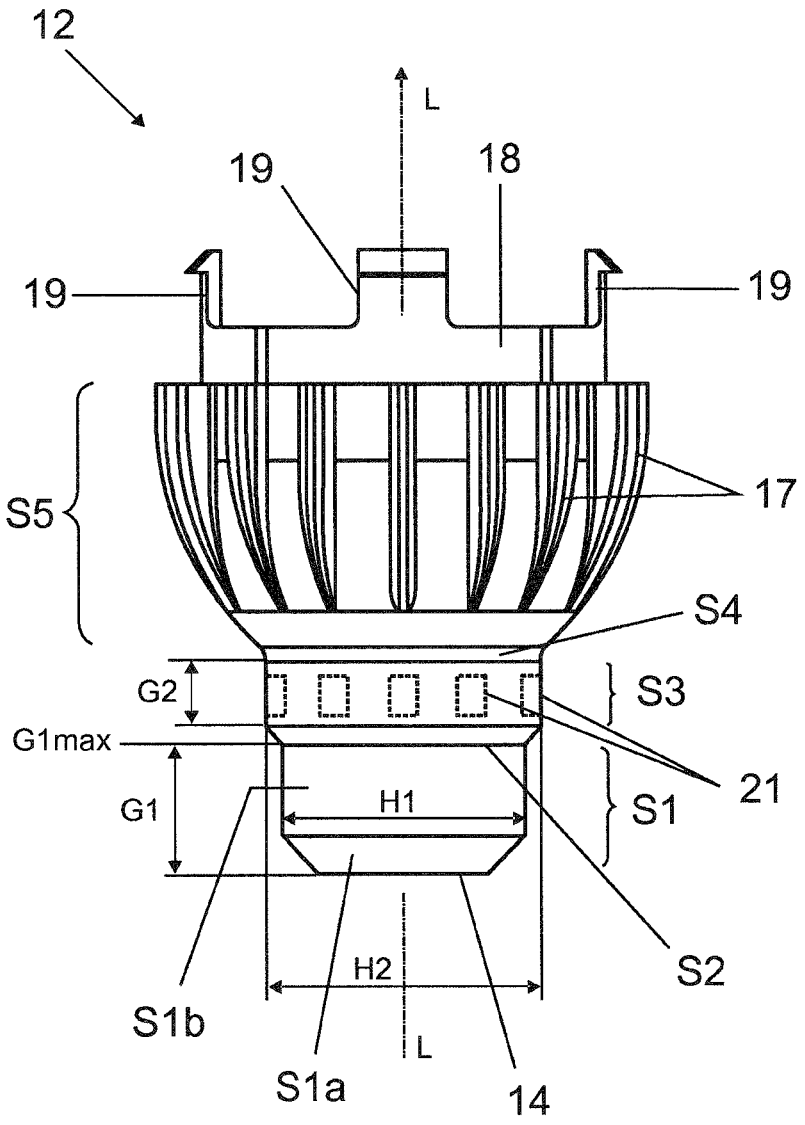
FIG. 2 illustrates the base region of the semiconductor lamp in a side view.

FIG. 1 illustrates a housing part of a semiconductor lamp 11 in the form of a rearward base region 12 in a view that is inclined from below. FIG. 2 illustrates the base region 12 in a side view.

The base region 12 includes a first base section S1 that is located at the end in relation to a longitudinal axis L and said base section is designed for the purpose of receiving the front ends of bipin contact pins 13 (cf. FIG. 3) and for this purpose includes two receiving cut-outs 15 on its rearward end face 14. The base region 12 includes a height G1 of at least approx. 12 mm (for example also including a height G1 of 12.5 mm) and is embodied above this height G1 for installation in a conventional bipin bulb socket. For a uniform installation into the conventional bipin bulb socket, the base region 12 includes at least at a maximum height of G1max an outer diameter H1 of approx. 22 mm to 23 mm.

The first base region S1 is constructed along the longitudinal axis L from two subsections S1 *a* and S1 *b* and said subsections in each case include a circular cross-sectional outer contour. The relatively rearward facing subsection S1 *a* includes the end face 14 having its diameter of approx. 16 mm and expands therefrom forwards to the outer side (in the direction of the longitudinal axis L) and indeed in a conical manner at an angle of approx. 45°. The relatively forward facing subsection S1 *b* includes an at least fundamentally cylindrical outer peripheral contour. The outer contour may expand outwards slightly in the forwards direction, for example by 2°.

A second base region S3 connects to the front end of the first base region S1 by way of a conically expanding intermediate section S2. The second base section S3 having a diameter of approx. 25 mm includes a larger outer diameter H2 than the first base section S1. A height G2 of the second base section S3 amounts in this case to between approx. 7 mm and approx. 8 mm.

The second base region S3 includes depressions 21 that are arranged on its outer face in a uniformly distributed manner in the circumferential direction.

A shell-shaped receiving section S5 for the purpose of receiving a driver 16 (cf. FIG. 3) is connected to the second base section S3 by way of a further conically expanding intermediate section S4. The receiving section S5 includes, on its outer face, several cooling ribs 17 that protrude perpendicularly (extending parallel to the longitudinal axis L) and are distributed in the circumferential direction. On a front end rim 18, the receiving section S5 includes several latching hooks 19 that are distributed in the circumferential direction for the purpose of engaging in a latching manner in an upper or front housing part 20 (cf. FIG. 3). The base region can therefore also be described as a lower or rearward housing part.

The base region 12 is embodied as an injection-molded synthetic material part.

Figure 3:
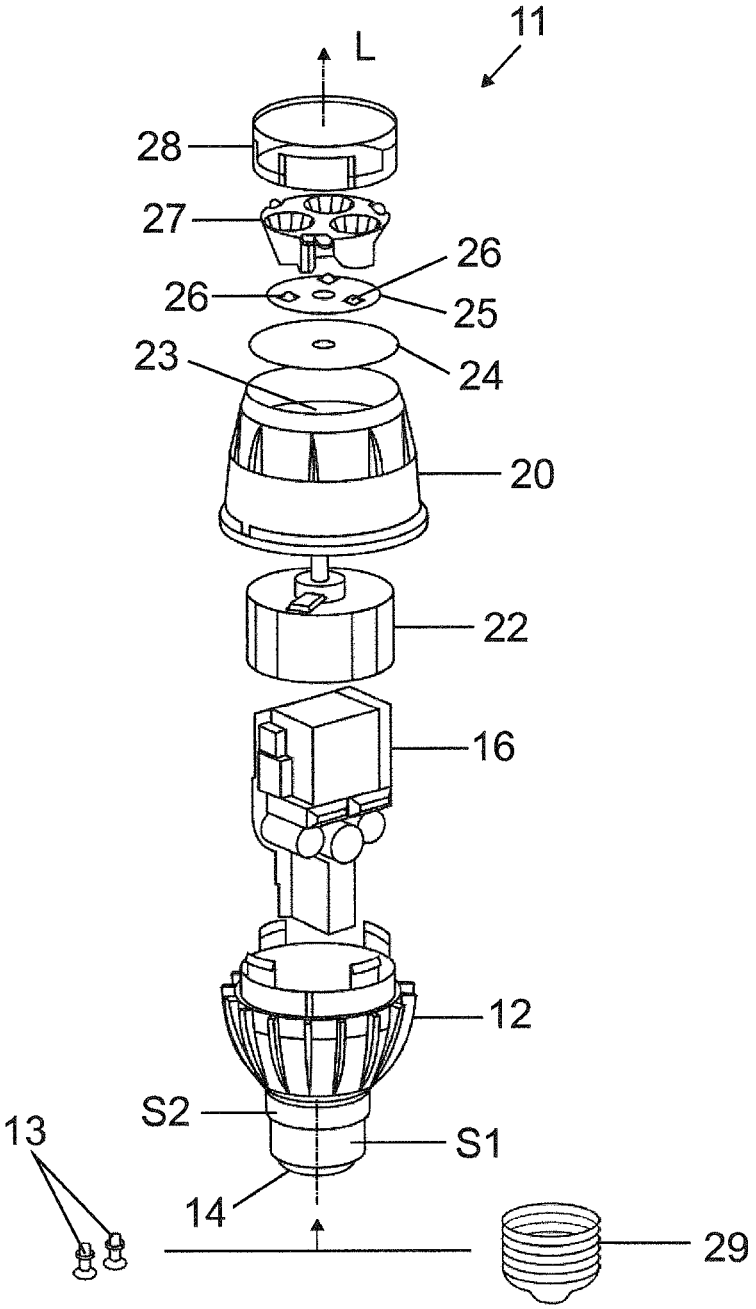
FIG. 3 illustrates the semiconductor lamp in an exploded view in a view that is inclined from above.

FIG. 3 illustrates the semiconductor lamp 11 in an exploded view in a view that is inclined from above. The most rearward housing part of the semiconductor lamp 11 is the base region 12 in which the driver 16 is inserted. An electrically insulating covering cap 22 is attached to the driver 16 on the front end (in the direction of the longitudinal axis L) and said covering cap is used for the purpose of fixing the driver 16 and for the purpose of electrically insulating said driver with respect to the front housing part 20. The front housing part 20 can latch on to the base region 12 and thus forms a driver cavity for the purpose of receiving the driver 16. The front housing part 20 includes, on its front face, a contact surface 23 for the purpose of contacting a carrier 24. The carrier 24 lies with its rear face on the contact surface 23 and carries an LED substrate 25 on its front face. The LED substrate 25 is equipped with three semiconductor light sources in the form of light diodes 26 that are attached to the front face of said LED substrate. For the purpose of operating the light diodes 26, it is possible for suitable electrical lines (not illustrated in the figures) to be provided between said light diodes and an output side of the driver 16.

Furthermore, a reflector 27 is attached to the front face of the carrier 24 and said reflector can form beams from the light that is emitted by the light diodes 26. A transparent cover 28 is provided as the uppermost element and said cover can be attached to the front housing part 20, in particular in a latching manner.

At least one electrical contact element 13 or 29 is arranged on the base region 12 for the purpose of electrically contacting the semiconductor lamp 11 and said contact element can electrically contact at least one suitable electrical (counter) element of the bulb socket (not illustrated in the figures). The base region 12 is embodied in such a manner that different electrical contact elements 13 or 29 can be selectively arranged thereon. The electrical contact elements 13 or 29 can be allocated in particular to different socket types. The electrical contact elements 13 or 29 include, in a purely exemplary manner and not limited thereto, electrical contact elements in the form of two contact pins 13 of a bipin base (for example of the type GU, in particular GU10) as well as a (contact-) cap 29 having two contact regions of an Edison base (for example E27). In lieu of the cap 29 of the Edison base, it is possible for example to also use a cap of a bayonet base (for example B22d). As a result of the possibility of being able to an extent to flexibly equip the base region 12 with the at least one contact element 13, 29, it is possible to produce the semiconductor lamp 11 with different base types in a considerably simplified manner. By way of example, it is possible to achieve a reduction in components for different base types. As a consequence, a simplified machine concept is rendered possible. Furthermore, a so-called "production-on-demand" having a reduction in diversity of part pieces is possible in a simpler manner. Costs related to storing basic materials are also reduced. Furthermore, it is possible to achieve shorter conversion periods between different base types during the production process. It is also possible to simplify an assembly process.

In particular, it is possible using a fundamentally known method to insert the two contact pins 13 into the receiving cut-outs 15 and to connect said contact pins in an electrical manner to an input side of the driver 16. In the case of inserting the semiconductor lamp 11 in a suitable bulb socket for example of the type GU10, a standard process of engaging the first base section S1 with the bulb socket is performed.

Alternatively, it is not necessary to provide the contact pins 13 and rather the cap 29 can be pushed from behind onto the (lateral) outer face of the base region S1. The cap 29 is pulled over the second base section S3 and lies on the outer face of said second base section in a frictionally-engaged manner. The first base section S1 is received in the cap 29. In order to connect the driver 16 to the cap 29 in an electrical manner, it is possible to provide in a known manner, for example in a threaded manner, current supplying elements or power supply lines.

For the purpose of fixing the cap 29 to the base region 12 in a form fitting manner, the cap 29 can be pressed in locally in a plastic manner into the depressions for example crimped or burled.

By way of example, it may also be possible with a single base region to achieve different bipin bases, for example of the type GU and GZ, or different Edison bases, for example of the type E27 and E26. Simple plug-in bases can also be achieved.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A semiconductor lamp comprising:

a housing, and at least one semiconductor light source that is arranged on the housing, wherein the housing comprises a rearward base region that is embodied from an electrically non-conductive material for the purpose of engaging in a bulb socket, wherein at least one electrical contact element is arranged on the base region for the purpose of contacting the bulb socket and wherein the base region is designed for selectively mounting electrical contact elements of different base types on said base region.

2. The semiconductor lamp as claimed in claim 1, wherein the base region is designed for selectively mounting electrical contact elements at least of two base types of the group consisting of an Edison base, a bipin base and a bayonet base.

3. The semiconductor lamp as claimed in claim 2, wherein the base region comprises a first, end-side base section that is designed for receiving bipin contact pins on its front side and for installation in a bipin lamp socket, and a second base section joined to the front of the end-side base section and said second base section comprises a larger diameter than the first base section and is designed such that the electrical contact element in the form of a contact cap of an Edison base or a bayonet base can endwise be plugged onto said second base section.

4. The semiconductor lamp as claimed in claim 3, wherein the first base section comprises a height of approx. 12 mm.

5. The semiconductor lamp as claimed in claim 4, wherein the first base section comprises at least at a maximum height a diameter of approx. 22.6 mm.

6. The semiconductor lamp as claimed in claim 3, wherein the second base section comprises a diameter of approx. 25 mm.

7. The semiconductor lamp as claimed in claim 3, wherein the second base section comprises a height of approx. 7.5 mm.

8. The semiconductor lamp as claimed in claim 3, wherein the second base section comprises on the side at least one depression into which the contact cap can be pressed locally in a plastic manner.

9. The semiconductor lamp as claimed in claim 3, wherein the Edison base is of the type E27, the bipin base is of the type GU10 and the bayonet base is of the type B22d.

10. The semiconductor lamp as claimed in claim 1, wherein the base region is a lower housing region of a driver housing that is provided for the purpose of receiving a driver.

11. The semiconductor lamp as claimed in claim 10, wherein an upper housing region of the driver housing comprises a contact surface for the at least one semiconductor light source.

12. The semiconductor lamp as claimed in claim 8 having an Edison base or a bayonet base, wherein semiconductor bulb is produced by a method, the method comprising:

pushing on the contact cap;

connecting at least one current carrying element; and locally pressing in the contact cap in at least one depression that is arranged on the side of the second base section.

13. A method for producing a semiconductor lamp, the method comprising the following steps:

providing a semiconductor lamp according to claim 8;

connecting at least one current carrying element; and locally pressing in the contact cap in at least one depression that is arranged on the side of the second base section.

14. A semiconductor lamp comprising:

a housing, and at least one semiconductor light source that is arranged on the housing, wherein the housing comprises a rearward base region that is embodied from an electrically non-conductive material for the purpose of engaging in a bulb socket, wherein at least one electrical contact element is arranged on the base region for the purpose of contacting the bulb socket, wherein the base region is designed for arranging electrical contact elements of different base types at least of two base types of the group consisting of an Edison base, a bipin base and a bayonet base, wherein the base region comprises a first, end-side base section that is designed for receiving bipin contact pins on its front side and for installation in a bipin lamp socket, and a second base section joined to the front of the end-side base section and said second base section comprises a larger diameter than the first base section and is designed such that the electrical contact element in the form of a contact cap of an Edison base or a bayonet base can endwise be plugged onto said second base section.

* * * * *